US009010007B2

(12) United States Patent
Chandler et al.

(10) Patent No.: US 9,010,007 B2
(45) Date of Patent: Apr. 21, 2015

(54) CONTROLLED ACCESS ARTICLE FOR HOUSING SHOTGUNS

(76) Inventors: Alan D. Chandler, Sedro Woolley, WA (US); Fred P. Hood, Eugene, OR (US)

( * ) Notice: Subject to any disclaimer, the term of this patent is extended or adjusted under 35 U.S.C. 154(b) by 0 days.

(21) Appl. No.: 12/832,628

(22) Filed: Jul. 8, 2010

(65) Prior Publication Data

US 2012/0005935 A1 Jan. 12, 2012

(51) Int. Cl.

| | |
|---|---|
| ***F41A 17/54*** | (2006.01) |
| ***F41A 23/18*** | (2006.01) |
| ***F41A 17/46*** | (2006.01) |
| ***F41A 17/02*** | (2006.01) |
| ***F41A 17/04*** | (2006.01) |

(52) U.S. Cl.

CPC ..... *F41A 23/18* (2013.01); *F41A 17/46* (2013.01); *F41A 17/54* (2013.01); *F41A 17/02* (2013.01); *F41A 17/04* (2013.01)

(58) Field of Classification Search

CPC ..... F41A 17/02; F41A 17/46; F41A 17/54; F41A 23/18; F41A 17/04

USPC ..... 42/70.11, 70.07; 206/315.11; 211/64

See application file for complete search history.

(56) References Cited

U.S. PATENT DOCUMENTS

| | | | | |
|---|---|---|---|---|
| 5,050,330 | A * | 9/1991 | Pilgrim et al. | 42/94 |
| 5,138,786 | A * | 8/1992 | Fischer | 42/70.11 |
| 5,392,552 | A * | 2/1995 | McCarthy et al. | 42/70.07 |
| 5,918,402 | A * | 7/1999 | Weinraub | 42/70.07 |
| 6,009,654 | A * | 1/2000 | Williams et al. | 42/70.11 |
| 6,330,815 | B1 * | 12/2001 | Duncan | 70/58 |
| 6,427,497 | B1 * | 8/2002 | Mossberg et al. | 70/18 |
| 6,488,148 | B1 * | 12/2002 | Woodson | 206/317 |
| 6,845,640 | B2 * | 1/2005 | Loeff et al. | 70/63 |
| 6,880,282 | B1 * | 4/2005 | Olsen | 42/70.11 |
| 2002/0133998 | A1 * | 9/2002 | Murray et al. | 42/70.07 |
| 2007/0051026 | A1 * | 3/2007 | Vor Keller | 42/70.11 |

* cited by examiner

*Primary Examiner* — Stephen M Johnson

(74) *Attorney, Agent, or Firm* — Jensen & Puntigam PS

(57) ABSTRACT

The article includes a body portion which is large enough to accommodate and cover a receiver portion of a shotgun, leaving the stock and most of the barrel of the shotgun exposed outside of the body portion when the shotgun is positioned within the body portion. The body portion includes a base portion, a rotatable lid portion with two extending latch members and a lock assembly, wherein the receiver portion of the shotgun fits between the base portion and the cover portion when the cover portion is locked to the lock assembly by the two latch members.

8 Claims, 3 Drawing Sheets

CONTROLLED ACCESS ARTICLE FOR HOUSING SHOTGUNS

TECHNICAL FIELD

This invention relates generally to an article of manufacture for providing controlled access to a gun, in particular a shotgun; and more specifically concerns such an article which has been adapted to prevent access to the receiver portion of a shotgun when the article is locked.

BACKGROUND OF THE INVENTION

It is widely recognized that it is important to control access to weapons, in particular guns, especially in a home environment. Typically, a gun owner will want to have fast and convenient access to a gun, but also will want to prevent access to the gun by others, particularly children, and/or intruders. Articles known as gun safes are useful for this purpose; these can even be used when the gun is loaded. But gun safes do have disadvantages, in particular, they are expensive, and heavy, with the weight making them inconvenient to mount on a wall. Furthermore, it is often difficult to obtain prompt access to a gun contained within a gun safe.

Hence, it is desirable to have an article which provides reliable access protection for a gun, such as a shotgun, conveniently mountable on a wall or the like, with prompt accessibility to the gun, as well as being less costly than conventional gun safes.

SUMMARY OF THE INVENTION

Accordingly, an article for providing controlled access to a shotgun is disclosed herein, comprising: an article body having a length sufficient to cover a receiver area of a shotgun, leaving the stock and most of the barrel of the shotgun outside of the article body when the shotgun is properly positioned in the article body, wherein the article body includes a base portion, a movable lid portion with at least one securing member and a lock assembly, wherein the shotgun is securely held between the base portion and the lid portion and the lid portion is prevented from opening when the lid portion with the securing member is locked to the lock assembly.

BEST MODE FOR CARRYING OUT THE INVENTION

Figure 1:
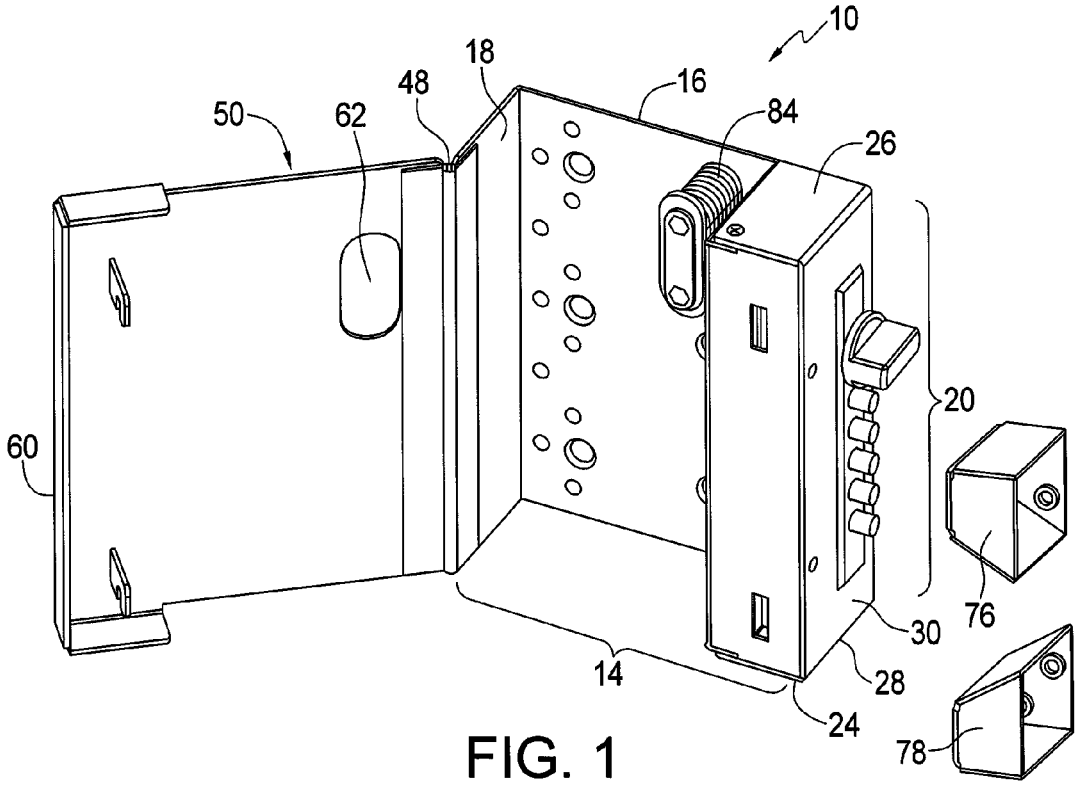
FIG. 1 is a perspective view showing the article for controlling access to guns, particularly a single shotgun.
Figure 2:
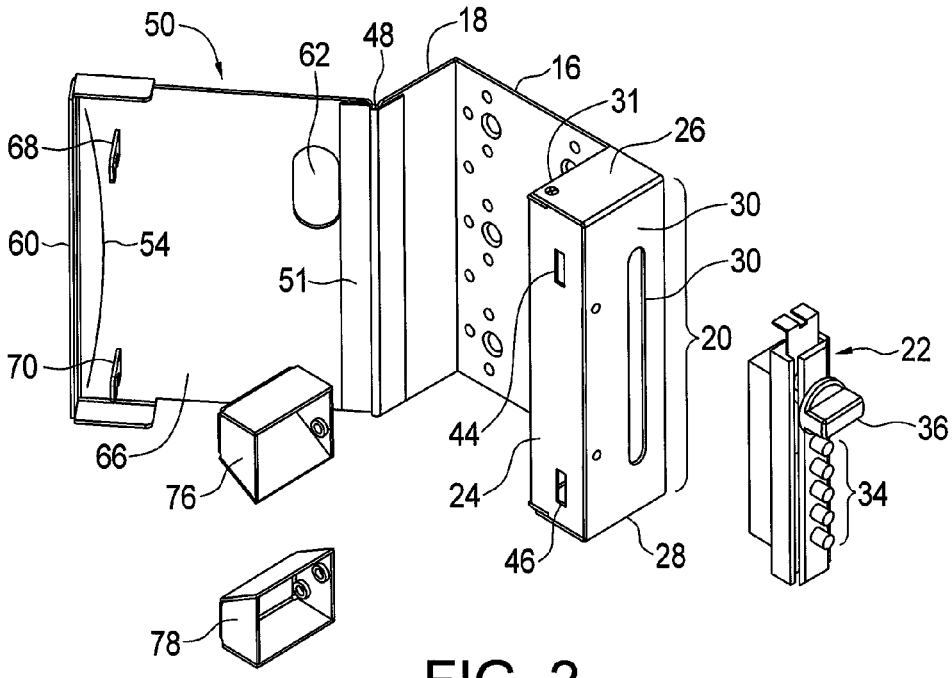
FIG. 2 is an exploded view of the article of FIG. 1, arranged with one type of shotgun support.

FIG. 1 shows a locking box article 10 for controlling access to a shotgun positioned therein. Locking box 10 includes a body portion 14 which in turn includes a flat back wall 16, a side wall 18 which extends along one side edge of back wall 16 and forms one side of the locking box, and a side enclosure 20 positioned along the other side of the back wall, in which is mounted a lock assembly 22. In the embodiment shown, back wall 16 is approximately 5.65 inches wide and 7.275 inches high. The side wall 18 is also 7.275 inches high and approximately 2.063 inches wide. The side enclosure 20 is also 7.275 inches high, 2.213 inches deep and 1.450 inches wide. All of the portions of body portion 14 are steel, approximately 0.075 inches thick.

The side enclosure 20 includes a front portion 24, top and bottom portions 26 and 28, an outer portion 30 and an inner portion 31. The upper and lower portions and outer wall portion 30 are in the embodiment shown welded together to back wall 16. The inner portion 31 and front portion 24, referred to as a dust cover, are attached to the remainder of the enclosure by screws. Mounted within the enclosure 20 is the push-button programmable lock assembly, shown generally at 22. Lock 22 is conventional and is available commercially. One example is Illinois Lock No. D900. Comparable locks are available from other manufacturers. Lock 22 includes five push buttons 34 and a rotatable lock button 36. The push buttons 34 and the shaft on which the lock button 36 is located extend through an elongated slot 40 in outer portion 30 of enclosure 20.

Located in the front portion 24 of side enclosure 20 are two openings 44 and 46 located near the top and bottom of the front portion 24. Openings 44 and 46 receive latch members mounted on a lid portion of the locking box.

Rotatably mounted to forward edge 48 of side wall 18 is a box lid 50. Box lid 50 in the embodiment shown is 5.675 inches wide and 7.125 inches high. Lid 50 is attached to forward edge 48 of side wall 18 by means of a hinge 51 or the like, which extends for the heigth of the lid, so that the lid is freely rotatable about forward edge 48. Extending for the full height of the lid at free edge 54, at 90° from the surface of lid 50 is an edge wall 60. In the embodiment shown, edge wall 60 is 0.75 inches wide and 7.535 inches high. Extending back a short distance along the top and bottom edges of lid 50 and toward forward edge 48 of side wall 18 are tabs 58 and 60. Tabs 58 and 60 are approximately 0.75 inches long and approximately 0.78 inches wide. In the embodiment shown, an oval opening 62, approximately 1.875 inches long and 0.875 inches wide at its widest spot, located in the upper left-hand corner of lid 50 when box lid 50 is closed. Box lid 50 is also made of steel, approximately 0.075 inches thick.

Specific dimensions have been set forth relative to a particular embodiment of the article of FIG. 1. It should be understood, however, that the dimensions can be varied, i.e., the configuration and size of the locking box can vary.

Extending from the interior surface 66 of lid 50 are two spaced latching hooks 68 and 70. Latching hooks 68 and 70 are also made of steel, and are positioned and arranged so that when lid 50 is closed, latching hooks 68 and 70 fit through openings 44 and 46 and fit around a locking bar portion of lock assembly 22, preventing removal of the lid until the correct preset pushbutton combination of the lock assembly provided by the user. Although two hooks are shown, one could be sufficient, or more than two. The hooks may take different configurations.

Figure 4:
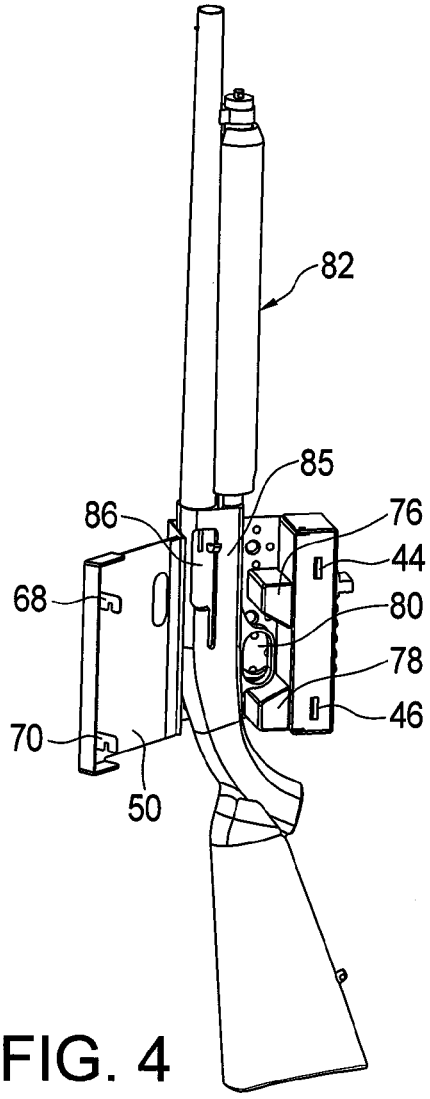
FIG. 4 is a perspective view of the article of FIG. 2 with a shotgun mounted therein.
Figure 5:
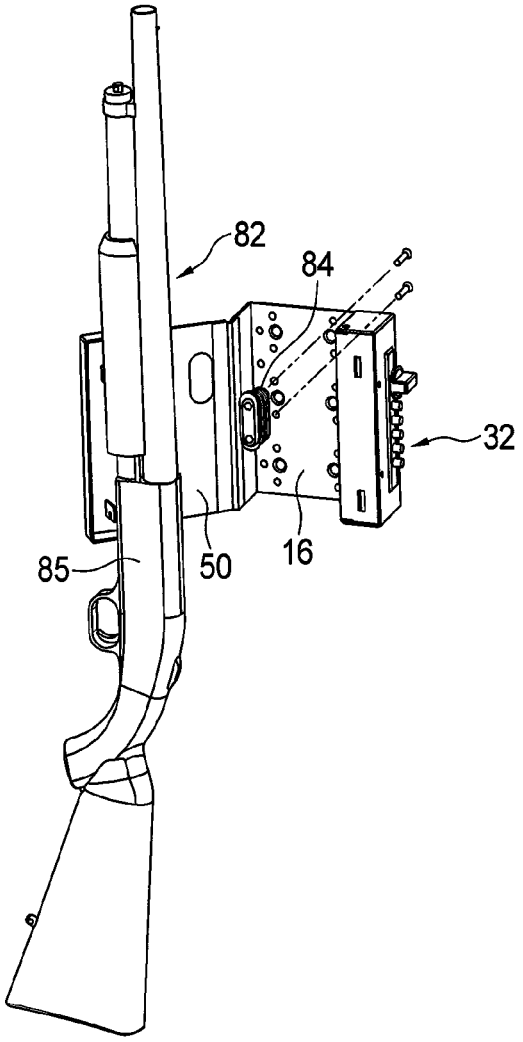
FIGS. 5 and 6 are perspective views of the article of FIG. 3, with a shotgun mounted therein.

Attachable to the inner portion 31 of the dust cover are top and bottom trigger blocks (containment blocks) 76 and 78. When attached, they are positioned so that the trigger guard 80 of the shotgun is positioned therebetween (FIG. 4). The trigger blocks 76 and 78 each have a slanted face, which oppose each other, permitting positioning of the trigger guard therebetween. The trigger blocks are useful when a shotgun 82 is mounted as shown in FIG. 4, holding a shotgun in place within a locking box.

Figure 3:
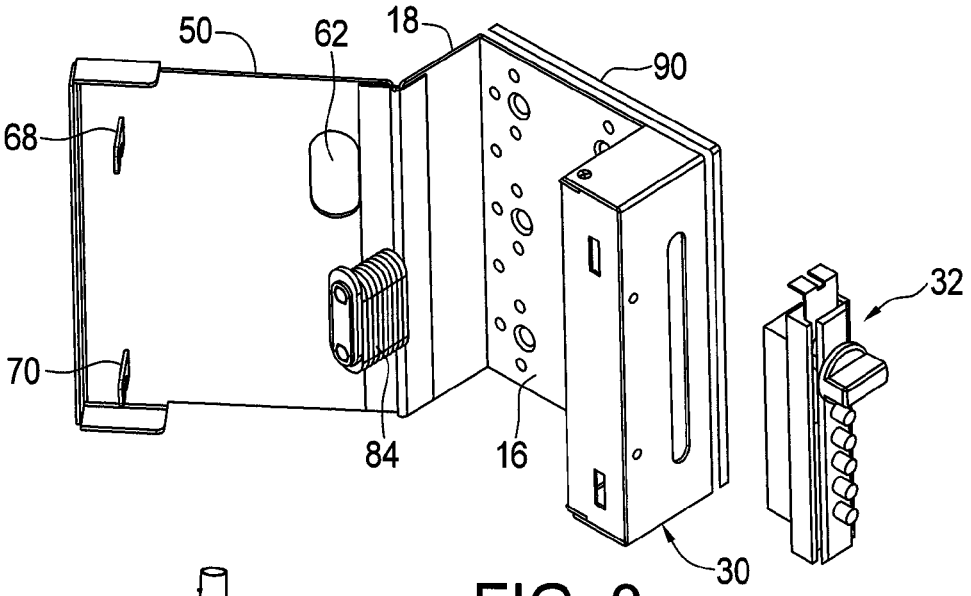
FIG. 3 is an exploded view of the article of FIG. 1, arranged with another type of shotgun support.
Figure 6:
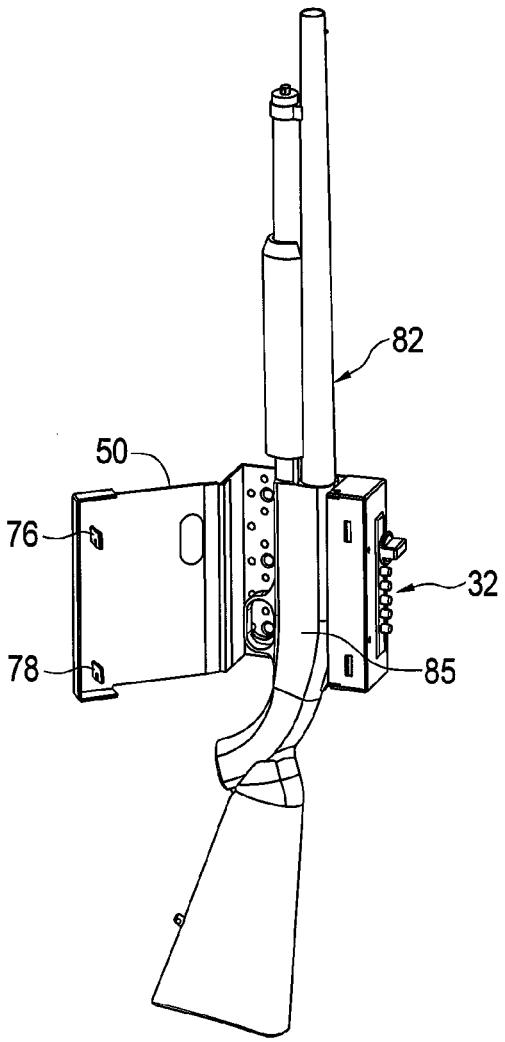

The article can also include a pump action hanger assembly 84, as shown in FIG. 3, as an alternative to trigger blocks 76 and 78. The hanger assembly 84 is attachable by screws or the like to the back wall 16 of the box body. Hanger assembly 84 is configured to fit into an open action portion 86 (FIG. 4) of the shotgun, when the shotgun is positioned in an orientation as shown in FIG. 6 in the locking box. In the embodiment shown, the hanger is approximately 2 inches long by ¾ inch wide and 1½ inches high and is curved at the opposing ends thereof. It should be understood that both the trigger guard blocks and the hanger assembly can be positioned opposite to that of FIGS. 4 and 6 for use with left-handed shotguns.

The locking box 10 may be mounted against a wall, or other surface capable of supporting the locking box and its contents, with screws which can be inserted through various openings provided in back wall 16. This results in a secure attachment of the locking box to the wall or other surface. A layer of felt 90 or similar soft material such as foam can be positioned between the back wall and the mounting wall for protection of the locking box and the wall. In addition, felt or similar material can be positioned on the interior surfaces of the lid, the back wall and the surfaces of the trigger blocks to provide protection for the shotgun.

A shotgun 82 to be locked is positioned in the locking box, with the trigger 80 positioned between trigger blocks 76 and 78. Alternatively, when the hanger assembly is used, the action portion of the shotgun is opened and the ejection port 86 of the shotgun is positioned over the hanger assembly 84.

To lock the locking box 10, lid 50 is simply rotated so that latches 68, 70 are moved through openings 44 and 46 in side enclosure 20 and lock to the locking bar portion of push-button lock 22. In this position, lid 50 covers the entire receiver portion 85 of the shotgun, and access to shotgun 82 is effectively and securely prevented until the locking box is unlocked by proper operation of the pushbutton lock.

When access is desired, the locking assembly is operated by pushing the correct preset individual buttons 34 and the locking button then rotated, which releases the latches from the locking bar. The lid may then be opened, providing access to the shotgun.

Accordingly, a locking box for a shotgun has been disclosed which is easy to operate and is readily mountable on a wall or similar surface, providing complete safety for a shotgun, encapsulating the receiver so that the shotgun cannot be operated. Even a loaded shotgun can be safely mounted in the locking box.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. An article for providing controlled access to a shotgun, comprising:

a non-portable article body structurally adapted to be mounted on a wall for holding a shotgun in a fixed position having a length which covers approximately just a receiver area of a shotgun, leaving the stock and most of the barrel of the shotgun outside of the article body when the shotgun is properly positioned in the article body, wherein the article body includes a base portion, a lid portion with at least one securing member extending therefrom, a hinge member moveably connecting the lid portion to the base portion, a side enclosure fixedly attached to the base portion, and a lock assembly, positioned within the side enclosure, wherein the lid portion with the at least one securing member is capable of being locked and released from the lock assembly, wherein the shotgun is securely held between the base portion and the lid portion and the lid portion is prevented from opening when the lid portion with the at least one securing member is locked to the lock assembly, wherein the article further includes first and second spaced containment blocks mounted so that the containment blocks are positioned parallel to the barrel of the shotgun, on opposing sides of and adjacent to a trigger guard portion of the shotgun, holding the shotgun in place in the article body.

2. The article of claim 1, wherein the at least one securing member includes one or more latch members which fit into corresponding openings in the lock assembly, wherein they are securely held by the lock assembly when the lock assembly is in a locked condition, preventing the lid portion from being opened.

3. The article of claim 2, wherein the lock assembly is a push-button lock programmed to release the latch members when the preselected push buttons are operated by a user.

4. The article of claim 1, wherein the base portion of the article body is adapted for mounting to a wall.

5. The article of claim 4, including a foam member positioned against a rear surface of the base portion.

6. The article of claim 1, wherein the lock assembly is positioned within an enclosure which extends along one side of the article.

7. The article of claim 6, wherein the first and second spaced containment blocks are attached to the enclosure, configured and spaced to accommodate a trigger portion of the shotgun, for holding the shotgun in place within the article body.

8. An article for providing controlled access to a shotgun, comprising:

a non-portable article body structurally adapted to be mounted on a wall for holding a shotgun in a fixed position having a length which covers approximately just a receiver area of a shotgun, leaving the stock and most of the barrel of the shotgun outside of the article body when the shotgun is properly positioned in the article body, wherein the article body includes a base portion, a lid portion with at least one securing member extending therefrom, a hinge member moveably connecting the lid portion to the base portion, a side enclosure fixedly attached to the base portion, and a lock assembly, positioned within the side enclosure, wherein the lid portion with the at least one securing member is capable of being locked and released from the lock assembly, wherein the shotgun is securely held between the base portion and the lid portion and the lid portion is prevented from opening when the lid portion with the at least one securing member is locked to the lock assembly, wherein the article further includes a hanger assembly configured and positioned so that it fits into an open action portion of the shotgun when the shotgun is positioned within the article body, holding the shotgun in place in the article body.

* * * * *